US005102570A

United States Patent [19]

Migdal et al.

[11] Patent Number: 5,102,570

[45] Date of Patent: Apr. 7, 1992

[54] ACYLATED MANNICH BASE MONO AND/OR BIS-SUCCINIMIDE LUBRICATING OIL ADDITIVES

[75] Inventors: Cyril A. Migdal, Croton-on-Hudson; Richard A. Abramshe, Yorktown Heights; Theodore E. Nalesnik, Wappingers Falls, all of N.Y.

[73] Assignee: Texaco Inc., White Plains, N.Y.

[21] Appl. No.: 636,478

[22] Filed: Dec. 31, 1990

[51] Int. Cl.[5] ..... C10M 105/26; C07D 207/40

[52] U.S. Cl. ..... 252/51.5 A; 252/51.5 R; 252/51; 252/50; 548/546; 548/547

[58] Field of Search ..... 252/51.5 A; 548/546, 548/547

[56] References Cited

U.S. PATENT DOCUMENTS 3,442,808 5/1969 Traise ..... 252/51.5 A
3,493,520 2/1970 Verdol ..... 252/51.5 A
3,563,960 2/1971 Verdol ..... 252/51.5 A
4,699,724 10/1987 Nalesnik ..... 252/51.5 A
5,030,369 7/1991 Emert ..... 252/51.5 A

FOREIGN PATENT DOCUMENTS 2311839 4/1977 France .

*Primary Examiner*—Prince Willis, Jr.
*Assistant Examiner*—T. Steinberg
*Attorney, Agent, or Firm*—Robert A. Kulason; James J. O'Loughlin; Vincent A. Mallare

[57] ABSTRACT

A lubricating oil composition having improved dispersancy and antioxidancy. The dispersant being prepared by coupling mono- and/or bis-alkenyl succinimides with an aldehyde and hydroxyaromatic amine. The resulting coupled succinimide is then acylated with an acylating agent to form a Mannich hydroxyaromatic amine coupled acylated mono and/or bis-alkenyl succinimide.

15 Claims, No Drawings

ACYLATED MANNICH BASE MONO AND/OR BIS-SUCCINIMIDE LUBRICATING OIL ADDITIVES

BACKGROUND OF THE INVENTION

This invention is related to lubricating oil additives, and more particularly to acylated Mannich base-coupled mono and/or bis-succinimide multi-purpose lubricating oil additives.

It is well known that internal combustion engines operate under a wide range of temperatures including low temperature stop-and-go- service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkyl succinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Thus, an object of the present invention is to provide a lubricating oil composition having improved dispersancy and antioxidancy.

Another object is to provide a lubricating oil composition which can withstand the stresses imposed by modern internal combustion engines.

DISCLOSURE STATEMENT

U.S. Pat. Nos. 4,713,189 and 4,699,724 disclose a lubricating oil composition having improved dispersancy and Viton seal compatibility. The dispersant being prepared by coupling two mono-alkenyl succinimides with an aldehyde and a phenol,. The resulting coupled succinimide is then acylated with glycolic acid to form a glycolate Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolate succinimides with an aldehyde and a phenol.

U.S. Pat. Nos. 3,172,892 and 4,048,080 disclose alkenylsuccinimides formed from the reaction of an alkyne succinic anhydride and an alkylene polyamine and their use as dispersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic acid anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,131,150 discloses lubricating oil compositions containing dispersant-detergent mono- and dialkylsuccinimides or bis(alkenylsuccinimides).

Netherlands Patent 7,509,289 discloses the reaction product of an alkenyl succinic anhydride and an aminoalcohol, namely, a tris(hydroxymethyl) aminomethane.

U.S. Pat. application, Ser. No. 334,774, filed on Dec. 28, 1981, discloses a hydrocarbyl-substituted succinimide dispersant having a secondary hydroxy-substituted diamine or polyamine segment and a lubricating oil composition containing same.

U.S. Pat. No. 4 338 205 discloses alkenyl succinimide and borated alkenyl succinimide dispersants for a lubricating oil with impaired diesel dispersancy in which the dispersant is treated with an oil-soluble strong acid.

The disclosures, of U.S. Pat. Nos. 3,172,892; 4,636,322; 4,713,189; and 4,699,724; 4,579,674 are incorporated herein by reference.

SUMMARY OF THE INVENTION

The present invention provides a novel additive which improves the dispersancy and antioxidancy of a lubricating oil. The lubricating oil composition comprises a major portion of a lubricating oil and a minor dispersant amount of a reaction product (i.e., lubricant additive) which may be prepared as set forth below.

PROCESS

A process for preparing a lubricating oil additive comprising:

(a) reacting an amine with an alkenyl succinic acid anhydride to form a mono- and/or bis-alkenyl succinimide;

(b) adding a hydroxyaromatic amine and an excess of formaldehyde to the mono- and/or bis-alkenyl succinimide to form a Mannich hydroxyaromatic amine coupled mono- and/or bis-alkenyl succinimide;

(c) acylating the Mannich hydroxyaromatic amine coupled mono- and/or bis-alkenyl succinimide with an acylating agent, thereby forming a Mannich hydroxyaromatic amine coupled acylated bis-alkenyl succinimide; and (d) recovering the Mannich hydroxyaromatic amine coupled acylated mono- and/or bis-alkenyl succinimide.

DETAILED DESCRIPTION

In carrying out the present process, the reactants are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.g., a ($C_2$–$C_{10}$) monoolefin, the polymer having a number average molecular weight (Mn) of about 500 to about 10,000.

Preferred olefin polymers for reaction with the unsaturated dicarboxylic acid anhydride or ester are polymers comprising a major molar amount of ($C_2$–$C_{10}$) polymer, e.g., a ($C_2$–$C_5$) monoolefin.

Such olefins include ethylene, propylene, butylene, isobutylene, pentane, 1-octane, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight. In this case the alpha- or beta-unsaturated dicarboxylic acid anhydride is reacted with the saturated ethylene-propylene copolymer utilizing a radical initiator. The long chain hydrocarbyl substituted dicarboxylic acid producing material, e.g., acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumaratechloromaleic anhydride, and mixtures thereof.

The alkenyl succinic acid anhydride is characterized by the following formula:

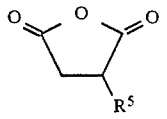

wherein the backbone polymer $R^5$ is polyolefin residue which was reacted with maleic acid anhydride to form the alkenyl succinic anhydride, and $R^5$ has a number average molecular weight (Mn) ranging from about 500–10,000, preferably from about 1000–5000, and more preferably from about 2000–2500.

The polyamine compositions which may be employed in practicing the present invention may include primary and/or secondary amines. The amines may typically be characterized by the formula

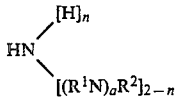

In this formula, a may be an integer of about 3 to about 8, preferably about 5; and may be 0 or 1; and n is 0 or 1. In the above compound, $R^2$ may be hydrogen or a hydrocarbon group selected from the group consisting of alkyl, aralkyl, cycloalkyl, aryl, alkaryl, alkenyl, and alkynyl, including such radicals when inertly substituted. The preferred $R^2$ groups may be hydrogen or a lower alkyl group, i.e. $C_1$–$C_{10}$ alkyl, groups including e.g., methyl, ethyl, n-propyl, ipropyl, butyls, amyls, hexyls, octyls, decyls, etc. $R^2$ may preferably be hydrogen. $R^1$ may be a hydrocarbon selected from the same group as $R^2$ subject to the fact that $R^1$ is divalent and contains one less hydrogen. Preferably $R^2$ is hydrogen and $R^1$ is —$CH^2CH^2$—. Typical amines which may be employed may include those listed below in Table 1.

TABLE 1

| | |
|---|---|
| diethylenetriamine | (DETA) |
| triethylenetetramine | (TETA) |
| tetraethylenepentamine | (TEPA) |
| pentaethylenehexamine | (PEHA) |

The aldehyde which may be employed may include those preferably which characterized by the formula $R^3CHO$. In the preceding compound, $R^3$ may be hydrogen or a hydrocarbon group consisting of alkyl, aralkyl, cycloalkyl, aryl, alkyaryl, alkenyl, and alkynyl including such radicals when inertly substituted i.e. it may bear a non-reactive substituent such as alkyl, aryl, cycloalkyl, ether, halogen, nitro, etc. Typically inertly substituted $R^3$ groups may include 3-chloropropyl, 2-ethoxyethyl, carboethoxymethyl, 4-methyl cyclohexyl, p-chlorophenyl, p-chlorobenzyl, 3-chloro-5-methylphenyl, etc. The preferred $R^3$ groups may be lower alkyl, i.e. $C_1$–$C_{10}$ alkyl, groups including methyl, ethyl, n-propyl, isopropyl, butyls, amyls, hexyls, octyls, decyls, etc. may preferably be hydrogen.

Typical aldehydes which may be employed may include those listed below in Table 2.

TABLE 2

| |
|---|
| formaldehyde |
| ethanal |
| propanal |
| butanal etc. |

The hydroxyaromatic amine compound is represented by the formulas

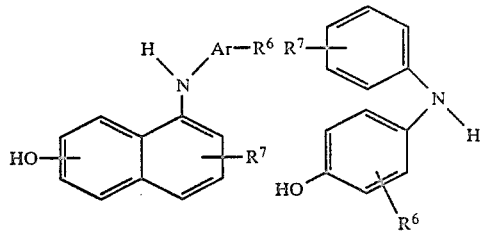

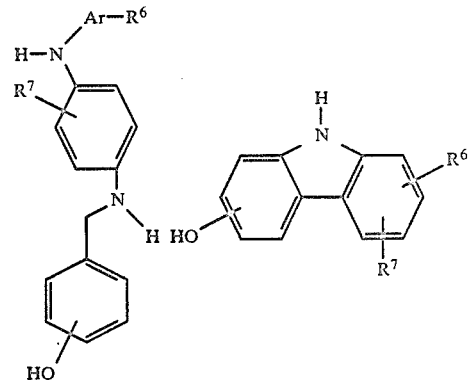

in which $R^6$ is H, —NHaryl, —NHarylalkyl, a branched or straight chain radical having 4 to 24 carbon atoms that can be alkyl, alkenyl, alkoxyl, aralkyl, alkaryl, hydroxyalkyl or aminoalkyl; $R^7$ is H, an alkyl, alkenyl, alkoxyl, aralkyl or alkaryl group having from 4 to 24 carbons. The preferred hydroxyaromatic amine being 4-hydroxydiphenylamine.

It is a feature of these hydroxyaromatic amines that they contain an active hydrogen which will be a site for substitution. Poly-phenols (e.g., compounds containing more than one hydroxy group in the molecule whether on the same ring or not) may be employed. The rings on which the hydroxy groups are situated may bear substituents. However, at least at one positions, e.g., ortho- and para-, to a hydroxy group, must be the occupied by an active hydrogen as this is the point of reaction with the iminium salt group. The preferred hydroxyaromatic amine is 4-hydroxydiphenylamine.

The secondary amine groups of the polyalkenylamine moiety in said coupled mono- and/or bis-alkenyl succinimide are reacted with either an acylating and/or borating agent.

The acylating agent may be a carboxylic acid such as a hyroxyaliphatic acid or a fatty acid. The suitable fatty acids are straight chain compounds, ranging from 3 to 18 carbons. They may be saturated or unsaturated. Saturated acids include lauric, myristic, pentadecanoic, palmitic, margaric and stearic. Unsaturated acids include myristoleic, palmitoleic, oleic, linoleic and linolenic.

The hydroxyaliphatic acid preferably used as an acylating agent is a carboxylic acid characterized by the formula HO—$R^4$—COOH, wherein $R^4$ is an alkyl group having from 1 to about 4 carbon atoms and the hydroxyl group can be located at any available position therein.

The preferred acylating agents are glycolic acid, oxalic acids, lactic acid, 2-hydroxymethylpropionic acid, and 2,2-bis(hydroxymethyl) propionic acid, the most preferred being glycolic acid.

It is understood that equivalents of the carboxylic acids prescribed, namely their anhydrides, esters and acyl halides, can also be employed in the practice of this invention. A characteristic of the preferred $C_2$ and $C_3$ hydroxyaliphatic carboxylic acids is their relatively limited or negligible solubility in mineral oil.

The lubricating oil of the invention will contain the novel reaction product in a concentration ranging from about 0.1 to 30 weight percent. A concentration range for the additive ranging from about 0.5 to 15 weight percent based on the total weight of the oil composition is preferred with a still more preferred concentration range being from about 1 to 8.0 weight percent.

Oil concentrates of the additives may contain from about 1 to 75 weight percent of the additive reaction product in a carrier or diluent oil of lubricating oil viscosity.

The novel reaction product of the invention may be employed in lubricant compositions together with conventional lubricant additives. Such additives may include additional dispersants, detergents, antioxidants, pour point depressants, anti-wear agents and the like.

The novel additive reaction product of the invention was tested for its effectiveness as a dispersant and as an antioxidant in a fully formulated lubricating oil composition.

According to the present invention, the Mannich hydroxyaromatic amine coupled mono-and/or bis-alkenyl succinimide may instead of being acylated, be borated with a boron-containing compound to form a borated Mannich hydroxyaromatic amine coupled mono-and/or bis-alkenyl succinimide.

The borating agent, e.g., boron containing compound, is selected from the group consisting of boric acid, boron oxide, boron halide, and a boron acid ester, to provide a borated derivative thereof.

A borating agent that may be used effectively is boric acid.

The above process and products are illustrated in the Examples below and by reviewing such Examples the present invention and its advantages will be more apparent.

EXAMPLE I

Preparation Of Acylated Mannich Hydroxyaromatic Amine Coupled Mono- And/Or Bis-Alkynyl Succinimide Dispersant A solution of polyisobutenylsuccinic acid anhydride (3965.0 g, 1.0 moles, PIBSA prepared from an approximately 2060 mol. wt. polybutene) in diluent oil (2347.3 g) was charged into a twelve liter 3-neck flask equipped with a mechanical stirrer, thermometer, thermocouple, and nitrogen inlet and heated to 60° C. Next pentaethylenehexamine (145.2 g, 0.55 moles) was added and the heat was increased to 120° C. and maintained for 2.0 hours. Then 4-hydroxydiphenylamine (50.0 g, 0.27 moles) was added, followed by a 37% solution of formaldehyde (87.6 g, 1.08 moles). The temperature was maintained at 120° C. for 0.5 hours. Next a 70% solution of glycolic acid (159.8 g, 1.48 moles) was added and the temperature was raised to 160° C. and then maintained for 4 hours to drive off water. The hot mixture (~100° C.) was filtered through diatomaceous earth filter aid. The product (an approximately 4% active concentrate) analyzed as follows: % N=0.70 (0.82 calc.) and Total Acid Number (TAN)=2.4.

EXAMPLE II

Preparation Of Acylated Mannich Phenol Coupled Mono- And/Or Bis-Alkynyl Succinimide Dispersant (Comparative Example)

Same as Example I, except an equimolar amount of nonylphenol substituted for 4-hydroxydiphenylamine. The product (an approximately 40% concentrate) analyzed as follows: % N=0.82 (0.71 calc.).

EXAMPLE III

Preparation Of Acylated Mannich Hydroxyaromatic Amine Coupled Mono- and/or Bis-Alkynyl Succinimide Dispersant A solution of polyisobutenylsuccinic acid anhydride (2799.0 g, 1.5 moles, PIBSA prepared from an approximately 1290 mol. wt. polybutene) in diluent oil (3225.0 g) was charged into a twelve liter 3-neck flask equipped with a mechanical stirrer, thermometer, thermocouple, and nitrogen inlet and heated to 60° C. Next pentaethylenehexamine (217.8 g, 0.825 moles) was added and the heat was increased to 120° C. and maintained for 2.0 hours. Then 4-hydroxydiphenylamine (74.9 g, 0.405 moles) was added, followed by a 37% solution of formaldehyde (131.4 g, 1.62 moles). The temperature was maintained at 120° C. for 0.5 hours. Next a 70% solution of glycolic acid (239.8 g, 2.22 moles) was added and the temperature was raised to 160° C. and then maintained for 4 hours to drive off water. The hot mixture (−~100° C.) was filtered through diatomaceous earth filter aid. The product (an approximately 40% active concentrate) analyzed as follows: % N=1.39 (1.25 calc.) and Total Base Number (TBN)=16.6.

EXAMPLE IV

Sequence VE Gasoline Engine Test Results

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles. The Sequence VE gasoline engine test results shown below in Table 3 were run in a single grade fully formulated motor oil.

TABLE 3

| | Sequence VE Gasoline Engine Test Results | | | | | | | |
|---|---|---|---|---|---|---|---|---|
| Dispersant | AS[1] | AV | RACS | PSV | % ORC | % OSC | $CLW_{avg}$ | $CLW_{max}$ |
| Example[2] I | 9.5 | 5.7 | 9.5 | 6.9 | 21.2 | 0.0 | 0.4 | 2.4 |
| Example[2] II (Comparative) | 8.4 | 4.4 | 7.4 | 6.9 | 25.0 | 0.0 | 4.0 | 11.2 |
| Limits | $9.0_{min}$ | $5.0_{min}$ | $7.0_{min}$ | $6.5_{min}$ | $15.0_{max}$ | $20.0_{max}$ | $5_{max}$ | $15_{max}$ |

[1]AS, AV, RACS, PSV, ORC, OSC, $CLW_{avg}$, and $CLW_{max}$ denote: average sludge, average varnish, rocker arm cover sludge, piston skirt varnish, oil ring clogging, oil screen clogging, cam lobe wear average, and cam lobe wear maximum, respectively.
[2]SAE 30 fully formulated motor oil

EXAMPLE V

Bench Sludge Test

This test is conducted by heating the test oil mixed with synthetic hydrocarbon blow by and a diluent oil at a fixed temperature for a fixed time period. After heating, the turbidity of the resulting mixture is measured. A low percentage turbidity (20–40) is indicative of good dispersancy while a high value (40 to 200) is indicative of an oil's increasingly poor dispersancy. The results obtained with the known and present dispersants are set forth below in Table 4 below at 6.5% percent by weight concentration, in a SAE 30W fully formulated motor oil.

TABLE 4

| Bench Sludge Test Results | |
|---|---|
| Dispersant | Rating |
| Example I | 27 |
| Example II (Comparative) | 33 |
| Reference (SG) | 30 |
| Reference (good) | 33 |
| Reference (fair) | 43 |
| Reference (poor) | 107 |

EXAMPLE VI

Bench Oxidation Test Results

The Bench Oxidation Test (BOT) was used to determine if the dispersants of this invention have anti-oxidant properties. In this test, the oil composition is heated to 175° C. under a blanket of nitrogen. A sample is taken to establish a base line. The oil is maintained at 175° C. while a stream of air is passed through it at the rate of 500 Ml/minute for six hours. Samples are taken every hour and the DIR of each sample is determined against the base line 1712 cm-1. The DIR is used as a measure of oxidation. In these tests, the oil employed was a solvent neutral oil having an SUS viscosity at 100° F. of 130. In the tested oils, the additive was employed at nitrogen concentration of 0.1 weight percent. The examples in Table 5, below, illustrate the surprising effectiveness of the novel lubricant additive when employed in a lubricating oil composition.

TABLE 5

| Dispersant | BOT Results[2] |
|---|---|
| Example I | 5.2 |
| Example II (Comparative) | 20.7 |
| Example III | 3.3 |

[2]The higher the number above 7 the more pro-oxidant character. The lower the number below 7 the more anti-oxidant character.

We claim:

1. A lubricating oil composition comprising a major portion of a lubricating oil and a minor amount of reaction product prepared the process comprising:

(a) reacting an amine with an alkenyl succinic acid anhydride at a temperature of about 60 to about 140° C. for 1–3 hours to form a mono-and/or bis-alkenyl succinimide;

(b) adding a hydroxyaromatic amine and an excess of formaldehyde to said mono-and/or bis-alkenyl succinimide at about 120° C. for about ½ to about 2 hours to form a Mannich hydroxyaromatic amine coupled mono-and/or bis-alkenyl succinimide;

(c) acylating said Mannich hydroxyaromatic amine coupled mono-and/or bis-alkenyl succinimide with an acylating agent at a temperature of about 140 to about 180° C. for a period of 2–6 hours, thereby forming a Mannich hydroxyaromatic amine coupled acylated mono-and/or bis-alkenyl succinimide; and (d) recovering said Mannich hydroxyaromatic amine couple acylated mono-and/or bis-alkenyl succinimide.

2. A lubricating oil composition according to claim 1, wherein said acylating agent is selected from the group consisting of glycolic acid, oxalic acid, lactic acid, 2-hydroxymethylpropionic acid and 2,2-bis (hydroxymethyl) propionic acid.

3. A lubricating oil composition according to claim 2, wherein said acylating agent is glycolic acid.

4. A lubricating oil composition according to claim 1, wherein said acylating is carried out at about 150° C. to about 175° C.

5. The lubricating oil composition of claim 1, wherein said amine is represented by the formula

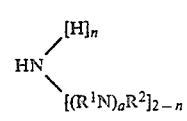

where $R^1$ is hydrogen or a hydrocarbon selected from the group consisting of alkyl, aralkyl, cycloalkyl, aryl, alkaryl. alkenyl and alkynyl group; $R^2$ is a hydrocarbon selected from the same group as $R^1$ except that $R^2$ contains one less H; a is an integer of about 3 to about 8; and n is 0 or 1.

6. The lubricating oil composition of claim 1, wherein said amine is selected from the group consisting of diethylenetriamine, triethylenetetramine, tetraethylenepentamine and pentaethylenehexamine.

7. The lubricating oil composition of claim 6, wherein said amine is tetraethylenepentamine.

8. The lubricating oil composition of claim 6, wherein said amine is pentaethylenehexamine.

9. The lubricating oil composition of claim 6, wherein said amine is triethylenetetramine.

10. The lubricating oil composition of claim 1, wherein said alkenyl succinic acid anhydride has a number average molecular weight of about 500 to about 10,000.

11. The lubricating oil composition of claim 1, wherein said hydroxyaromatic amine is 4-hydroxydiphenylamine.

12. The lubricating oil composition of claim 1, wherein said Mannich hydroxyaromatic amine coupled mono- and/or bis-alkenyl succinimide is instead of being acylated, borated with a borating agent to form a Mannich hydroxyaromatic amine coupled borated bis-alkenyl succinimide.

13. The lubricating oil composition of claim 12, wherein said borating agent is selected from the group consisting of boric acid, a boron acid ester, boron oxide and a boron halide.

14. The lubricating oil composition of claim 13, wherein said borating agent is boric acid.

15. A lubricating oil composition comprising a major portion of a lubricating oil and a minor amount of reaction product prepared the process comprising:

(a) reacting an amine with an alkenyl succinic acid anhydride at a temperature of about 60° to about 140° C. for 1-3 hours to form a mono-and/or bis-alkenyl succinimided;

(b) adding a hydroxyaromatic amine and an excess of formaldehyde to said mono-and/or bis-alkenyl succinimide at about 120° for about 0.5 to about 2 hours to form a Mannich hydroxyaromatic amine coupled mono-and/or bis-alkenyl succinimide, said hydroxyaromatic amine being represented by one of the formulas

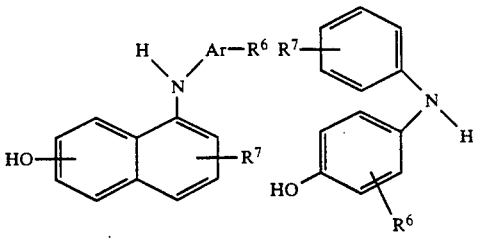

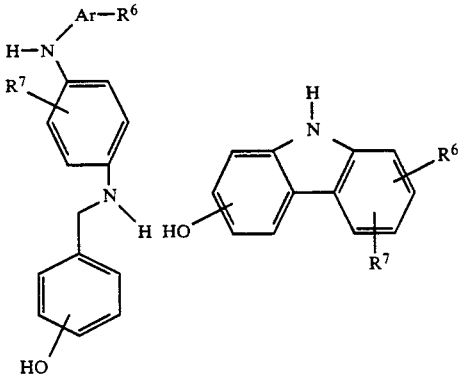

in which $R^6$ is H, —NHaryl, —NHarylalkyl, a branched or straight chain radical having 4 to 24 carbon atoms that can be alkyl, alkenyl, alkoxy, aralkyl, alkaryl, hydroxyalkyl or aminoalkyl; $R^7$ is H, an alkyl, alkenyl, alkoxy, aralkyl or alkaryl group having from 4 to 24 carbons;

(c) acylating said Mannich hydroxyaromatic amine coupled mono-and/or bis-alkenyl succinimide with an acylating agent at a temperature of about 140° to about 180° C. for a period of 2-6 hours, thereby forming a Mannich hydroxyaromatic amine coupled acylated mono-and/or bis-alkenyl succinimide; and (d) recovering said Mannich hydroxyaromatic amine couple acylated mono-and/or bis-alkenyl succinimide.

* * * * *